United States Patent [19]

Örnberg

[11] 4,101,167

[45] Jul. 18, 1978

[54] TILTING UNIT FOR FURNITURE SUBSTRUCTURES

[75] Inventor: Stellan Örnberg, Jönköping, Sweden

[73] Assignee: Kalmar Läns Landsting, Kalmar, Sweden

[21] Appl. No.: 689,152

[22] Filed: May 24, 1976

[30] Foreign Application Priority Data

Feb. 6, 1976 [SE] Sweden ..... 7601316

[51] Int. Cl.$^2$ ..... A47C 3/026

[52] U.S. Cl. ..... 297/328; 248/378

[58] Field of Search ..... 297/326, 327, 328, 303, 297/302, 269, 304; 248/397, 375, 384, 371, 378, 358 R, 22

[56] References Cited

U.S. PATENT DOCUMENTS

| | | | |
|---|---|---|---|
| 1,926,763 | 9/1933 | Cliffe | 248/375 |
| 2,184,988 | 12/1939 | Collier et al. | 248/375 |
| 2,503,796 | 4/1950 | Bruhn | 248/378 X |
| 2,524,418 | 10/1950 | Belisle | 297/269 X |
| 2,776,703 | 1/1957 | Belisle | 297/269 |
| 2,804,289 | 8/1957 | Schwayeke | 248/22 |
| 2,812,009 | 11/1957 | Skirvin | 248/378 |
| 2,907,373 | 10/1959 | Katz | 297/269 |
| 2,917,103 | 12/1959 | Korn | 248/375 |
| 3,133,763 | 5/1964 | Stoll et al. | 297/304 |
| 3,290,091 | 12/1966 | Goodman | 297/302 |
| 3,338,542 | 8/1967 | Meinhard | 248/358 R |
| 3,863,982 | 2/1975 | Sandham | 297/302 |

*Primary Examiner*—Francis K. Zugel

*Attorney, Agent, or Firm*—Blanchard, Flynn, Thiel, Boutell & Tanis

[57] ABSTRACT

A tilting unit for furiture, preferably for chairs, consists of two pivotably connected main parts, whereof one is attached to the chair foot or base and the other to the chair seat in order to allow limited tilting of the seat, the parts preferably being lockable together in a desired tilted position with the aid of handle operated locking means. Biassing means for yieldingly opposing tilting forces caused by the occupant comprise at least one block of resilient material located between opposing faces provided one on each of the unit parts.

8 Claims, 7 Drawing Figures

TILTING UNIT FOR FURNITURE SUBSTRUCTURES

The present invention relates to a tilting unit incorporated in furniture, especially for chairs, by means of which the piece of furniture, thus e.g. a chair, can perform a tilting movement on its foot or base.

Such a tilting unit is previously known for an easy or office chair, for example. On one hand the unit comprises a retaining structure attached to the tiltable seat of the chair, and on the other a carrying structure pivotably connected to the retaining structure and attached to the foot or base of the chair. A biassing or prestressing device, e.g. one such comprising one or more springs, is interposed between the retaining and carrying structures for urging the seat towards an initial or rest position at one end position of the relative tilting movement. The tilting unit may also be provided with locking means. In one known form of locking means the carrying structure has a projecting arm with surfaces intended for locking engagement located at a distance from the tilting axis of the two structures, clamping means fixed in relation to the retaining structure being arranged to frictionally engage, when desired, said locking surfaces of the arm, and thereby to disable the relative tilting movement between the retaining structure and the carrying structure.

This known tilting unit with associated locking means has been found to function well in practice, and a particular advantage is the possibility which the locking means offers for securing the chair, in a desired tilted or inclined attitude. A disadvantage is however that the prestressing device, which is incorporated in the tilting unit to balance out the weight of the occupant during the tilting movement of the chair, has been found to be rather expensive, due to the number of details (springs, sleeves, pins etc.) incorporated therein, and furthermore since the biassing device must be "loaded" on assembly, i.e. the associated spring or springs must be accomodated in a suitable spring housing in a stressed condition. The housing is then mounted in the tilting unit and acted on by set screws so that the unit is exposed to the entire spring force which then balances out the weight of the occupant during the tilting movement. It will be easily seen that the forces in question are large, and from the point of view of material strength, it is necessary to make the details of the spring unit rather robust, and consequently this force biassing portion of the tilting unit represents a considerable portion of its cost.

The invention has the object of providing a simplified force biassing device which is considerably cheaper to manufacture and simpler to assemble than the spring devices known heretofore.

According to this invention, the tilting unit is characterized in that the prestressing device interposed between the tiltable retaining structure and the carrying structure comprises at least one block of elastomeric material, preferably rubber, arranged to be exposed to elastic deformation between said structures and thereby to oppose their relative tilting movement.

The invention will now be described in more detail for the purpose of exemplification, with reference to the accompanying drawings, in which FIG. 1 is a side view of the tilting unit according to the invention located on the underside of, for example, an easy-chair seat;

Figure 1:
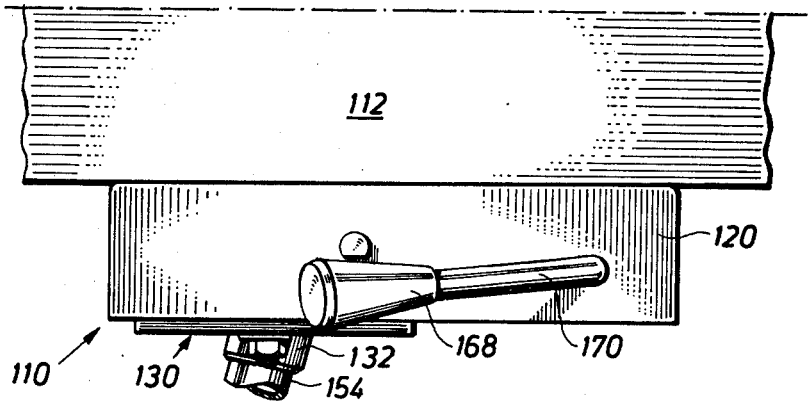
Figure 2:
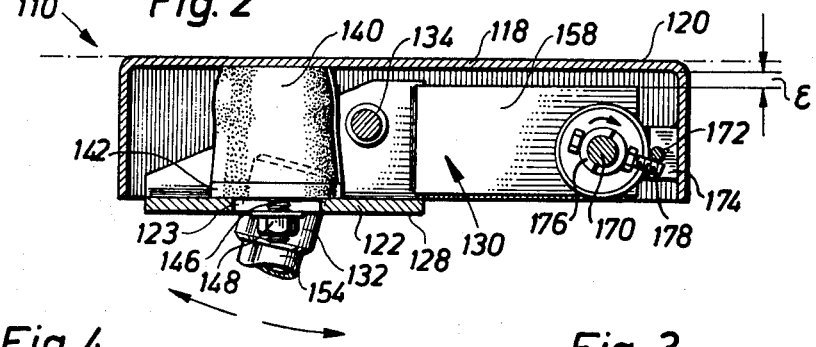
FIG. 2 is a corresponding view in cross-section, along the line II—II in FIG. 6.
Figure 4:
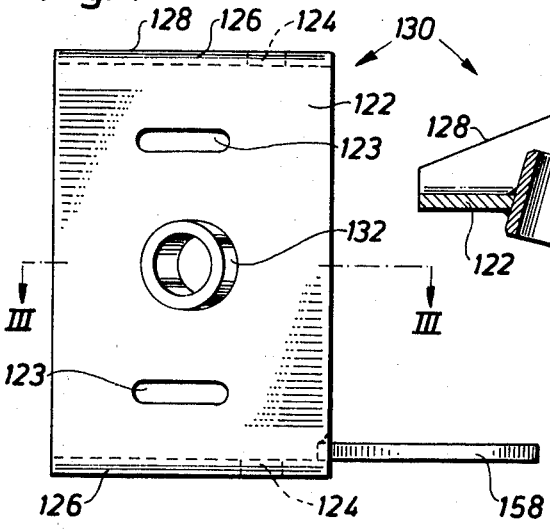
FIGS. 3 and 4 are detail views of carrying means incorporated in the unit, FIG. 3 being a section along the line III—III in FIG. 4.
Figure 3:
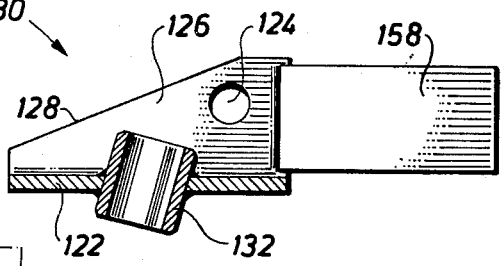

In FIGS. 1 and 2 there is shown in its entirety a tilting unit in accordance with the invention, the unit being designated 110. It is located on the underside of a chair seat indicated by 112 and comprises an outer housing or retaining structure in the form of a box 120, in the interior of which a carrying structure 130 is pivotably mounted via a shaft 134, said shaft extending across the retaining box 120 and accommodated in openings in two opposing sides of the box (see FIG. 6). The carrying structure 130 is shown in more detail in FIGS. 3 and 4, and comprises a U-shaped stirrup member 128, suitably made as a steel pressing, and providing bearing openings 124 in its two opposing legs 126. In the bridge portion 122 of this member 128 there is a bearing sleeve 132 passing through an aperture and welded therein so that the sleeve axis forms a required angle to the bridge portion, as is apparent from FIGS. 1 and 2. The sleeve 132 swivelably accommodates the upper end of a seat pillar 154, or the like. Since this is united with the carrying structure 130, the seat 112 with the retaining box 120 can pivot in relation to the pillar/carrying structure combination as is denoted by the arrows in FIG. 1. The stirrup member 128 of the carrying structure 130 is mounted on the transverse bearing shaft 134 with the aid of bearing bushes 136 of brass or bearing bronze (see FIGS. 2 and 6).

The stirrup member 128 of the carrying structure 130 is provided with an extended portion or arm 158 which, in the embodiment shown, consists of a flat plate or the like welded to one of the legs 126 of the stirrup member 128.

Figure 6:
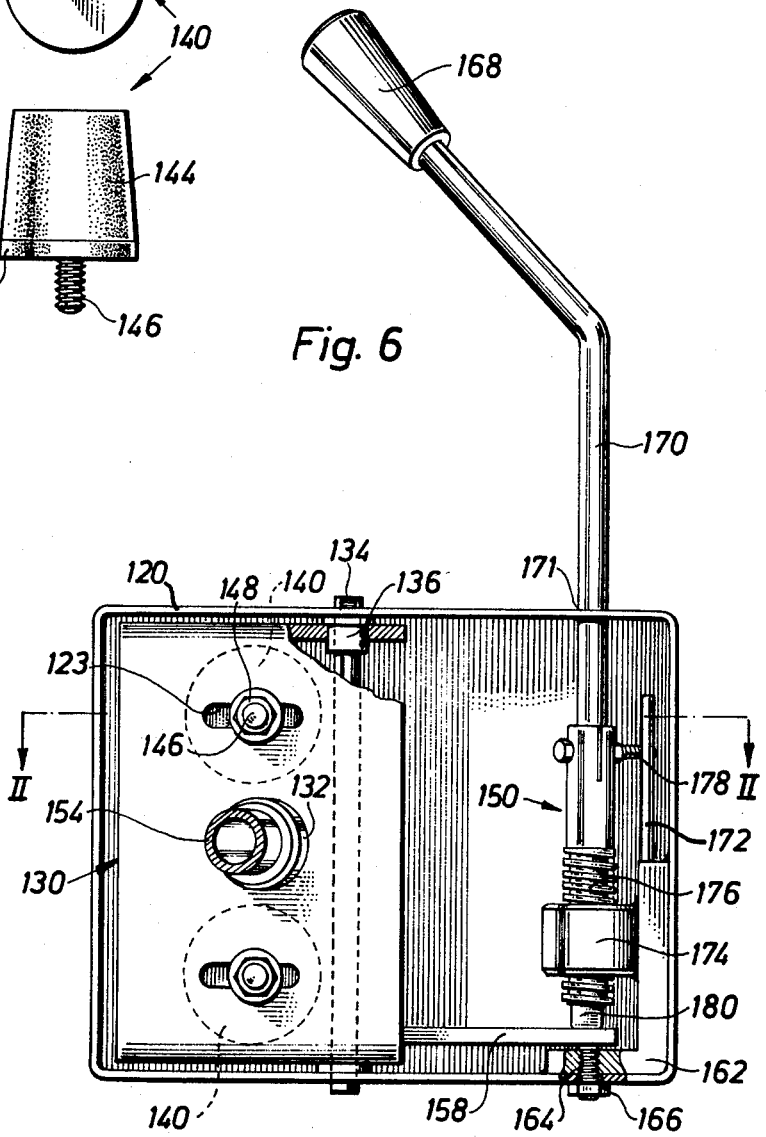
FIG. 6 is a plan view, seen from below and partially in section, of the tilting unit.

As is apparent from FIG. 6, the arm 158 extends from the stirrup member 128 to locking means 150 mounted in the retaining box 120 at the side remote from the stirrup member. This locking means is exemplified by an abutment mounting 162 rigidly attached to the box, to which is fixed a holding nut 174 through which passes a threaded spindle 176. At one end, the spindle is provided with a bore into which an operating lever 170, rotatably mounted via an aperture 171 in a side wall of the retaining box 120, is introduced and fastened by means of a locking screw 178. The other end of the spindle 176 is provided with an engagement portion 180. The outer end of the above mentioned arm 158 is accommodated, as shown, between said engagement portion 180 and the fixed abutment mounting 162 of the retaining box 120. The abutment mounting 162 is provided with a movable boss in the shape of a set screw 164 which, in an adjusted position, can be locked by means of a lock nut 166. The screw 164 is adjusted and locked in a suitable manner in close proximity to its adjacent face of the arm 158, whereby the outer end of the arm 158 can be nipped between the set screw 164 and the engagement portion 180 by manual operation of the lever 170 of the threaded spindle 176 without the arm being subjected to significant bending stresses. The operating lever 170 is bent near to its outer end and is arranged to project through the aperture 171 to such an extent that its outer end, which is provided with a handle or knob 168, is easily accessable to the chair occupant. It will be apparent that locking manipulation of the lever 170 will immovably lock the chair seat in relation to the carrying structure 130 and thus to the base pillar 154. The locking screw 178, by which the lever 170 is connected to the spindle 176, can suitably be extended and arranged to coact with a fixed stop in the shape of a pin 172, attached to the abutment mounting 162 (see FIGS. 2 and 6) for limiting the movement of the lever in the opening direction.

Figure 5:
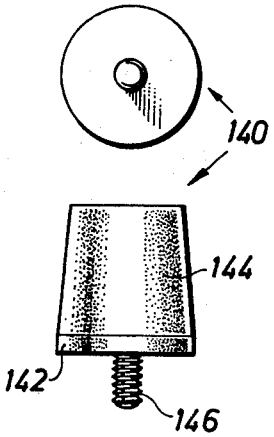
FIG. 5 is a plan view and side view of a rubber block incorporated in a prestressing or force biassing device of the unit.
Figure 7:
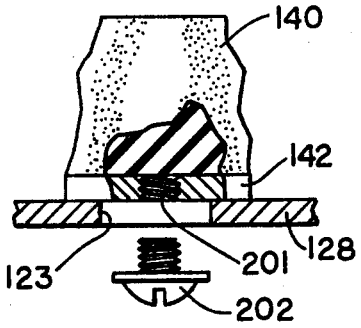
FIG. 7 is an exploded, partially partially broken fragment of FIG. 2 showing a modification.

It has been found that the biassing or prestressing device which, as mentioned hereinbefore, is required to balance out the forces to which the tilting unit is exposed, does not need to include pre-stressed coil springs or the like as known and used hereinbefore. Instead, a pair of simple elastic blocks, e.g. rubber blocks 140, as shown in FIG. 5, are used and are located between the bottom 118 of the retaining box 120 and the bridge portion 122 of the carrying structure 130, as is clearly apparent from FIG. 2 Each rubber block 140 (see FIG. 5) consists of a bottom plate 142 on which a rubber body 144 is vulcanized, and from which a fastening screw 146 projects. The rubber blocks are placed quite close to the mounting shaft 134 of the carrying structure 130, see FIG. 6, and their attachment screws 146 are accommodated in elongated slots 123 in the bridge portion 122 of the stirrup member 128 so that the distance of the blocks from said mounting shaft can be adjusted. The location of the blocks is fixed by nuts 148 tightened onto the attaching screws 146 so that the blocks are firmly attached to the stirrup member 128, with their upstanding free ends bearing against the inner face of the bottom 118 of the retaining box 120. The arrangement is clearly apparent from FIG. 2, where a position is illustrated in which the retaining box 120 has been tilted clockwise about the mounting shaft 134 during compression of the rubber blocks 140 so that the outer end of the arm 158 is moved to a distance $\epsilon$ from the inner face of the bottom 118 of the retaining box 120. In this position the whole unit can be locked simply by turning the operating lever 170, and thereby the threaded spindle 176, clockwise as seen in FIG. 2, (where the locking direction is shown by means of an arrow). If the unit is then unloaded and unlocked, the retaining box 120 tilts backwardly anticlockwise, under the influence of the rubber blocks 140, until the outer end of the arm 158 is brought against the inside face of the retaining box bottom 118 ($\epsilon = 0$), i.e. the initial or rest position. For providing the removable attachment of the blocks 140, the bottom plate 142 can be provided with a threaded hole (as at 201 in FIG. 7) instead of a projecting fastening screw 146 as described above, in which case a conventional screw 202 is introduced through the respective slots 123 in the stirrup member 128 and screwed into the bottom plate 142.

It will be appreciated that the invention is not limited to the above described embodiment, but may be varied in different respects within the scope of the invention as claimed in the following claims.

I claim:

1. A tilting unit for furniture such as an easy or office chair including a seat tiltably mounted on a base, the tilting unit comprising:

a retaining structure attached to the seat of the chair;

a carrying structure pivotally supporting the seat retaining structure on a tilt axis and in turn attached to the base of the chair; and a prestressing means interposed between the retaining and carrying structures for resiliently urging the structures into an initial or rest position, said prestressing means comprising at least one solid block of elastomeric material located between said retaining and carrying structures and being confined on one side of the tilt axis, said block or blocks being exposed to elastic compression to oppose thereby the relative tilting movement of said retaining and carrying structures, means securing each elastomeric block to one and only one of said retaining and carrying structures, said securement being a releasable securement, and each said block being mounted in a position adjustable with respect to said tilt axis for thereby varying the resilient opposition to tilting;

said carrying structure comprising a generally U-shaped stirrup means having opposed legs connected by a bridge portion and pivotally connected to opposing sides of said retaining structure at such tilt axis, said securing means including an attaching screw for each block, said bridge portion including a pair of parallel elongated slots spaced side-by-side along said tilt axis and accommodating the block attaching screws of a pair of said blocks for adjustment of the distance of said blocks to the tilt axis of the stirrup means with respect to said retaining structure, said retaining structure having the form of a box, each said block being held in compression between said stirrup bridge portion and the bottom of said retaining box;

one leg of said stirrup means having a projecting arm having surfaces for locking engagement spaced from said tilt axis, said retaining box mounting a clamping means operable for gripping the locking surfaces of said arm therebetween and thereby locking the tilting unit in a desired tilted position.

2. A device as claimed in claim 1, in which each block consists of a rigid bottom plate, a rubber body fixed at one end to the bottom plate said securement means being associated with said bottom plate for removable securement to said one structure with the end of the rubber body remote from said bottom plate merely continuously abuting the other said structure.

3. A device as claimed in claim 2, in which said bottom plate of the rubber block is provided with a projecting threaded stud, constituting said attaching screw, for removable attachment to said carrying structure.

4. A device as claimed in claim 2, in which said bottom plate is provided with a threaded opening, constituting said securement means, for accommodating said attaching screw for removable attachment to said carrying structure.

5. A device as claimed in claim 1, in which clamping means comprises an abutment mounting rigidly attached to said retaining box, and a lever operated threaded spindle screwed into a nut fixed with respect to said retaining box and axially opposing said abutment mounting, said arm projecting from the stirrup means between an end of the threaded spindle and the abutment mounting such that the spindle is rotatable to clamp and lock fast said arm between it and the abutment mounting.

6. A device as claimed in claim 5, in which the part of said abutment mounting engageable with the said arm is an adjustable set screw movable towards and away from the opposing end of said threaded spindle, and means for locking the set screw in a suitable adjusted position in close proximity with the adjacent face of said arm.

7. A tilting unit for furniture such as an easy or office chair including a seat tiltably mounted on a base, the tilting unit comprising:

a substantially U-section stirrup member having upstanding sides connected by a bridge plate;

a chair seat supporting member overlying said stirrup member and having a substantially inverted box shape;

pivot means defining a substantially horizontal pivot axis through said sides of said stirrup member and corresponding sides of said chair seat member for pivotally supporting the latter on said stirrup member;

means for supporting said stirrup member including an upstanding pillar engaging said bridge plate between said stirrup member sides;

first and second elastomer blocks engaging said bridge plate on opposite sides of said piller and spacing said pillar from the sides of said stirrup member, wherein said pillar and first and second elastomer blocks are all offset in one direction from said pivot axis, said blocks being compressibly disposed between said chair seat member and said stirrup member plate and fixed to only one thereof, said elastomer blocks being mounted for adjustment toward and away from said pivot axis;

an arm extending fixedly from a side of said stirrup member along a corresponding side of said boxlike chair seat member and offset from said pivot axis in a direction opposite the location of said elastomer blocks, the free end of said arm being engageable with the top of said boxlike chair seat member to limit tilting thereof in response to extension of said elastomer blocks, a manually rotatable spindle supported for rotation on said chair seat member and having a threaded portion, threaded means fixed on said chair seat member and threadedly engaged by said spindle for axially advancing said spindle in response to rotation thereof, said spindle having an end opposing the free end of said arm, an abutment on said chair seat member and opposite the free end of said arm with said arm being snugly disposed between said spindle and said abutment, such that rotation of said spindle threadedly advances same to clamp said arm against said abutment and thereby preclude tilting of said chair seat member with respect to said stirrup member.

8. The apparatus of claim 7, including a pair of parallel slots through said stirrup member bridge plate, said slots being elongate and extending away from said pivot axis of said chair seat member, said slots being spaced on opposite sides of said pillar and also spaced inboard of said stirrup member sides, said first and second elastomer blocks each including a threaded member protruding through the corresponding one of said slots and associated threaded means for fixedly but adjustably clamping said first and second elastomer blocks on said stirrup member bridge plate with such blocks pushed against the opposed face of said chair seat member.

* * * * *